US007034812B2

(12) United States Patent
Chen et al.

(10) Patent No.: US 7,034,812 B2
(45) Date of Patent: Apr. 25, 2006

(54) METHOD AND APPARATUS OF AUTOMATICALLY TUNING OUTPUT LINE RATE AND DISPLAY CONTROLLER PROVIDED WITH THE SAME

(75) Inventors: Jiunn-Kuang Chen, Taoyuan (TW); Wen-Ho Hsiao, Hsinchu (TW); Hsu-Lin FanChiang, Hsinchu (TW)

(73) Assignee: MStar Semiconductor Inc., (TW)

( * ) Notice: Subject to any disclaimer, the term of this patent is extended or adjusted under 35 U.S.C. 154(b) by 272 days.

(21) Appl. No.: 10/291,832

(22) Filed: Nov. 12, 2002

(65) Prior Publication Data

US 2003/0184532 A1 Oct. 2, 2003

Related U.S. Application Data

(60) Provisional application No. 60/369,528, filed on Apr. 1, 2002.

(51) Int. Cl.
*G09G 5/00* (2006.01)

(52) U.S. Cl. ..... 345/204; 345/545; 345/556; 345/560; 345/698; 348/441; 348/459; 348/511; 375/240.01

(58) Field of Classification Search ..... 345/545, 345/556, 560, 698, 204; 348/511, 459, 411; 375/240.01

See application file for complete search history.

(56) References Cited

U.S. PATENT DOCUMENTS

| | | | | |
|---|---|---|---|---|
| 5,739,867 | A | 4/1998 | Eglit | 348/581 |
| 6,317,523 | B1 * | 11/2001 | Miura et al. | 382/298 |
| 6,636,222 | B1 * | 10/2003 | Valmiki et al. | 345/505 |
| 2002/0078317 | A1 * | 6/2002 | Yasoshima | 711/171 |
| 2003/0156639 | A1 * | 8/2003 | Liang | 375/240.01 |
| 2003/0164897 | A1 * | 9/2003 | Chen et al. | 348/459 |

* cited by examiner

*Primary Examiner*—Kent Chang
*Assistant Examiner*—Alexander S. Beck
(74) *Attorney, Agent, or Firm*—Michael Bednarek; Pillsbury Winthrop Shaw Pittman LLP

(57) ABSTRACT

A method and apparatus for automatically tuning the output line rate thereof and a display controller provided with the same. The display controller of the present invention provides a display controller having a line buffer, an input means, an output means, a status detector, and an auto-tune control means. The input means is employed to write line data into the line buffer at an input line rate, and the output means is employed to read the written line data from the line buffer at an output line rate. The status detector is coupled to the input means and the output means for generating a status signal indicating whether the input line rate and the output line rate are unbalanced. The auto-tune control means is used to adjust the output line rate in response to the status signal so as to balance the input line rate and the output line rate.

24 Claims, 10 Drawing Sheets

METHOD AND APPARATUS OF AUTOMATICALLY TUNING OUTPUT LINE RATE AND DISPLAY CONTROLLER PROVIDED WITH THE SAME

This application claims the benefit of Provisional Application No. 60/369,528, filed Apr. 1, 2002.

BACKGROUND OF THE INVENTION

1. Field of the Invention

The present invention generally relates to a display system for processing source image data by means of scaling technology. More particularly, the present invention relates to a method and apparatus for automatically tuning output line rate of a display controller.

2. Description of Related Arts

Display systems are employed to process source image data into output image data to be displayed on a display screen thereof. The source image data is usually provided by a graphics controller such as a graphics card, video decoder, digital camera, etc., and the resolution of the source image data is predetermined. Therefore, the source image data needs to be resized or scaled into an appropriate resolution such that the display screen can correctly display the output image data. Accordingly, a device used to process the source image data into the associated output image data is so-called a "display controller."

The display controller usually utilizes a line buffer with n blocks for read/write operations, which are subject to underrun or overrun due to undesirable read/write racing. Although firmware adjustment approach has been conventionally utilized to solve the buffer underrun or overrun issues, the user is required to realize the detailed operations of the image controller and manually adjust the associated parameters via firmware.

Thus, there is a need for a simple hardware-implemented display controller for tuning an image that has good image quality, fast tuning result, and a user-friendly interface.

SUMMARY OF THE INVENTION

It is therefore an object of the present invention to provide a method and apparatus for automatically tuning the output line rate of a display controller such that no buffer underrun or overrun occurs.

It is another object of the present invention to provide a method and apparatus for automatically tuning the output line rate of a display controller such that the associated output device parameters can be correspondingly adjusted.

It is yet another object of the present of the present invention to provide a method and apparatus for automatically tuning the output line rate of a display controller without manual firmware intervention.

For fulfilling the aforementioned objects, the present invention provides a display controller having a line buffer with n blocks, an input means, an output means, a status detector, and an auto-tune control means. The input means is employed to write the line data into the line buffer at an input line rate, and the output means is employed to read the written line data from the line buffer at an output line rate. The status detector is coupled to the input means and the output means for generating a status signal indicating whether the input line rate and the output line rate are unbalanced. The auto-tune control means is used to adjust the output line rate in response to the status signal so as to balance the input line rate and the output line rate.

Moreover, the present invention provided an auto-tune method, comprising the following steps of:

(a) writing the line data into a line buffer at an input line rate;

(b) reading the written line data from the line buffer at an output line rate;

(c) detecting the input line rate and the output line rate;

(d) generating a status signal indicating whether the detected input line rate and the output line rate are unbalanced; and (e) adjusting the output line rate by updating an output horizontal total number ohtot thereof responsive to the status signal until the input line rate and the output line rate are balanced.

It is to be understood that both the foregoing general description and the following detailed description are exemplary, and are intended to provide further explanation of the invention as claimed.

BRIEF DESCRIPTIOIN OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings, FIG. 1 is a block diagram of the display controller in accordance with one preferred embodiment of the present invention;

DETAILED DESCRIPTION OF THE PREFERRED EMBODIMENTS

Figure 1:
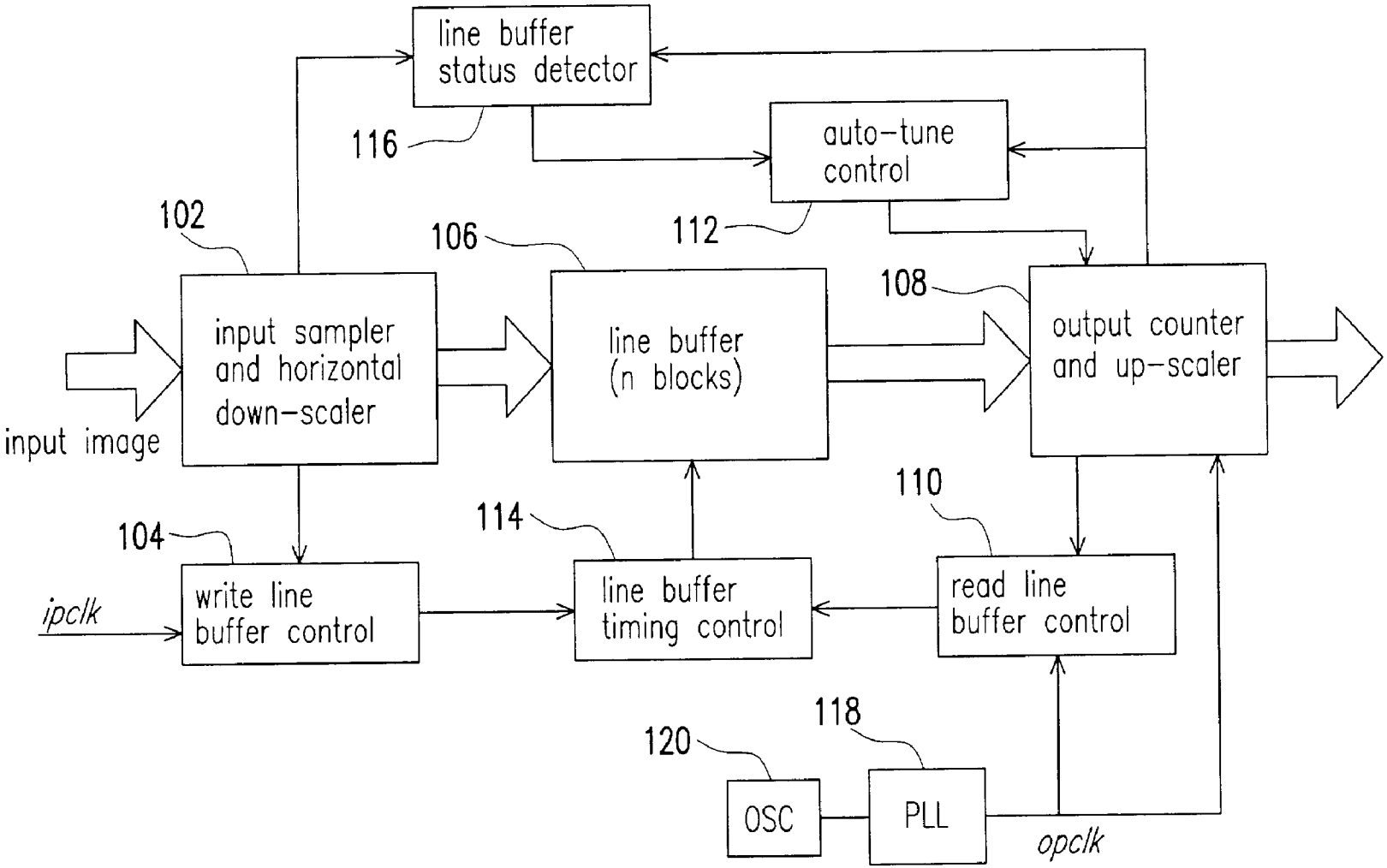

FIG. 1 is a block diagram of the display controller in accordance with one preferred embodiment of the present invention. As shown in FIG. 1, the display controller of the present invention comprises an input sampler and horizontal down-scaler 102, a write line buffer control 104, a line buffer 106 with n blocks, an output counter and up-scaler 108, a read line buffer control 110, an auto-tune control 112, a line buffer timing control 114, a line buffer status detector 116, a phase-locked loop (PLL) 118, and an oscillator 120. Source image data, such as scan line image data, are sampled by the input sampler 102 and, if necessary, down-scaled by the horizontal down-scaler thereof. The processed image data is thereafter stored in the line buffer 106 line by line and then outputted to the output counter and up-scaler 108 in response to timing control from the line buffer timing control 114. The line buffer 106 can be any type or combination of storage memory, which store the scan line image data. In this embodiment, the line buffer 106 is provided with n (n being an integer) blocks which can at the utmost store n lines of the image data. The up-scaler 108 receives the output from the line buffer 106 and generates the output image data to a display device (not shown in the drawings) according to an output pixel clock opclk from an output clock generator of the PLL 118 and the oscillator 120. As is described in further detail hereinafter, the output clock opclk is predetermined and fixed based upon the display panel specification. The block 108 further comprises the output counter for generating output timing by following output pixel count.

For example, if the line buffer 106 is a SRAM device, the write line buffer control 104 will generate SRAM addresses, data, and write-enable (WE) signals. Upon reception of the source image data, the write line buffer control 104 in response to an enable signal from the input sampler 102 together with an input pixel clock ipclk generates the WE signal to facilitate the write operation in the line buffer 106. Similarly, the read line buffer control 110 will generate SRAM addresses, data, and read-enable (RE) signals which may be provided with polarity opposite to that of the WE signals. The read line buffer control 110 in response to the output timing from the output counter and up-scaler 108 together with the output pixel clock opclk generates the RE signals for facilitating the read operation upon the line buffer 106. The line buffer timing control 114 is the line buffer read/write arbiter to switch read/write timing in the line buffer 106. In other words, the line buffer timing control 114 receives the WE signals from write line buffer control 104 and the RE signals from read line buffer control 110 to control the write and read operations of the line buffer 106 respectively.

Moreover, the line buffer status detector 116 is connected to the blocks 102 and 108 for detecting whether any buffer underrun or overrun for each image frame occurs by comparing the difference between an input line rate and an output line rate. The auto-tune control 112 in response to the detected result generated by the status detector 116 balances the read and write timing by means of auto-tune mechanism (to be described in the following), the auto-tune control 112.

Figure 2:
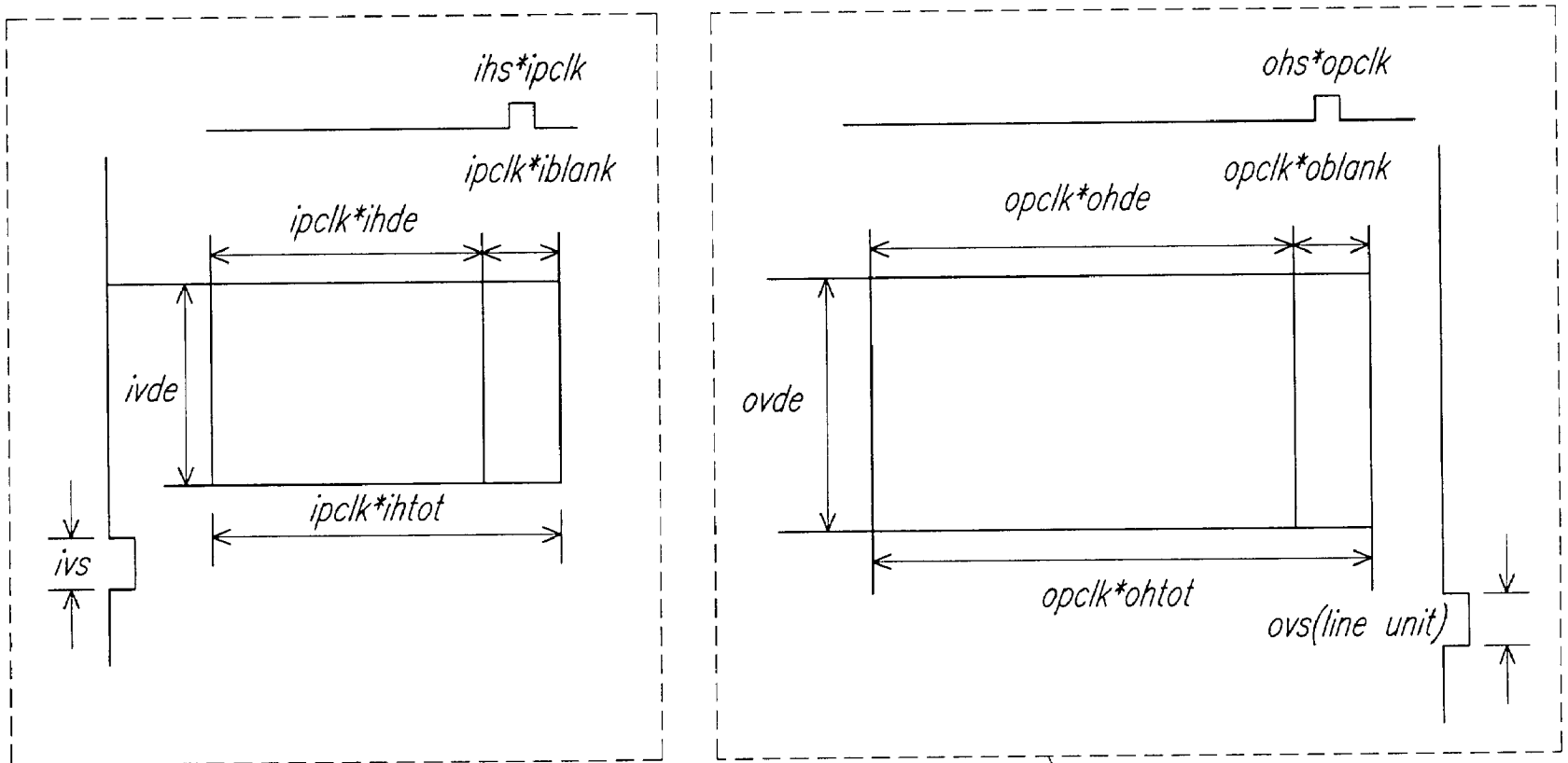
FIG. 2 is an input/output frame diagram.

FIG. 2 depicts an input/output frame diagram for explaining how a source image 202 is scaled to an output image 204. Usually, the frame period includes a display enable (DE) period and a blank period. The DE period represents the actual time while the source image data is scaled and the blank period designates the horizontal/vertical retrace time called horizontal synchronization (HS) and vertical synchronization (VS). The HS and VS are utilized by CRT monitors for polarized scan line retracing, but both are treated as reference signals in the application to LCD monitors. During the blank period, there are invalid image pixels. Therefore, an entire horizontal line is divided into two parts: one part contains valid image pixels in the display (DE) period and the other part contains invalid image pixels in the blank period. Thus, horizontal total pixel period=valid image pixel period+blank image pixel period, and vertical total scan lines=valid image scan lines+blank image scan lines.

Furthermore, some acronyms in FIG. 2 are described as below:

ipclk: input pixel clock;

ihtot: input horizontal total number;

ihde: input horizontal display enable number (valid image pixel period in ihtot), which is the pixel number to be written to the line buffer 106;

iblank: input horizontal blank number (invalid image pixel in ihtot);

ivde: input vertical display enable number (valid pixel scan lines);

ivs: input vertical synchronization scan lines;

opclk: output pixel clock to be generated by the oscillator-based PLL 118;

ohtot: output horizontal total number;

ohde: output horizontal display enable number (valid image pixel in ohtot), which is the pixel number to be scaled up after reading pixel from the line buffer 106;

oblank: output horizontal blank number (invalid image pixel in ohtot);

ovde: output vertical display enable number; and ovs: output vertical synchronization scan lines.

The equation (1) that states the relationship of the input pixels:

$$ihtot=ihde+iblank \quad (1)$$

The equation (2) that states the relationship of the output pixels:

$$ohtot=ohde+oblank \quad (2)$$

The equation (3) that defines the input frame display time:

$$\text{input frame display time}=ipclk\times ihtot\times ivde \quad (3)$$

The equation (4) that defines the output frame display time:

$$\text{output frame display time}=opclk\times ohtot\times ovde \quad (4)$$

Therefore, the display controller of the present invention receives the source image data according to the equation (3) and writes it into the line buffer 106. After waiting for a certain period, the display controller generates the output image data for the display device by means of reading and scaling the image data stored in the line buffer 106 in response to the output pixel clock opclk according to the equation (4).

Figure 3:
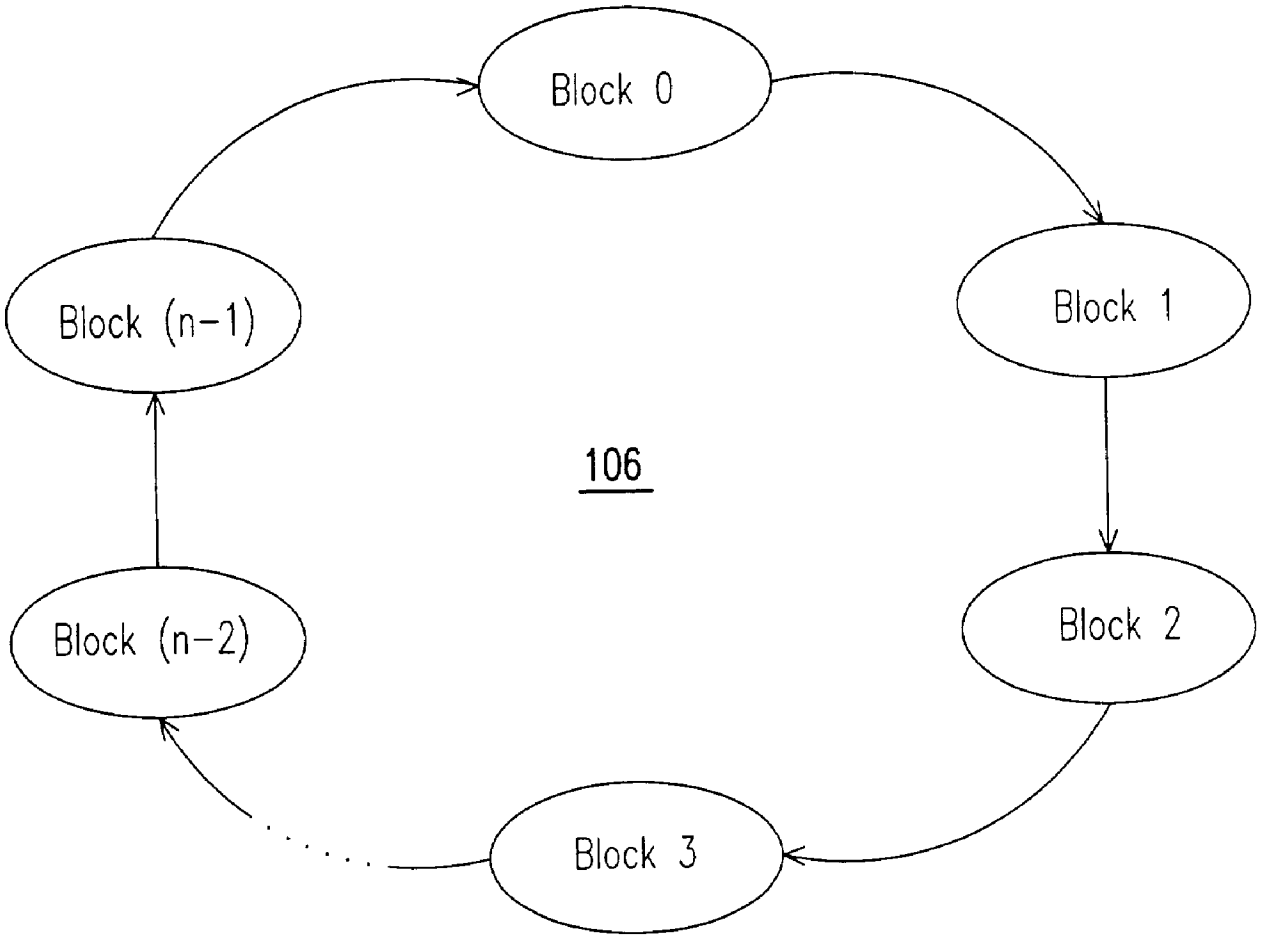
FIG. 3 is a diagram showing the line buffer in FIG. 1 provided with n blocks to be connected in form of a ring in accordance with the present invention.

Referring to FIG. 3, a diagram showing the line buffer 106 of FIG. 1 provided with n blocks (preferably, n=2~5) to be connected in the form of a ring in accordance with the present invention is schematically illustrated. By selecting a proper number of the blocks, the line buffer 106 configured with the ring buffer can eliminate the impact of write/read racing while maintaining the whole circuit workable. However, although the ring buffer in FIG. 3 can provide buffer function to balance the write speed and read speed, the input and output line rates should be adjusted to reach a balanced condition, which will be described in details as follows.

The equation (5) that defines the input line rate:

$$\text{Input line rate}=ipclk\times ihtot \quad (5)$$

The equation (6) that defines the output line rate $$\text{Output line rate}=opclk\times ohtot \quad (6)$$

Figure 4:
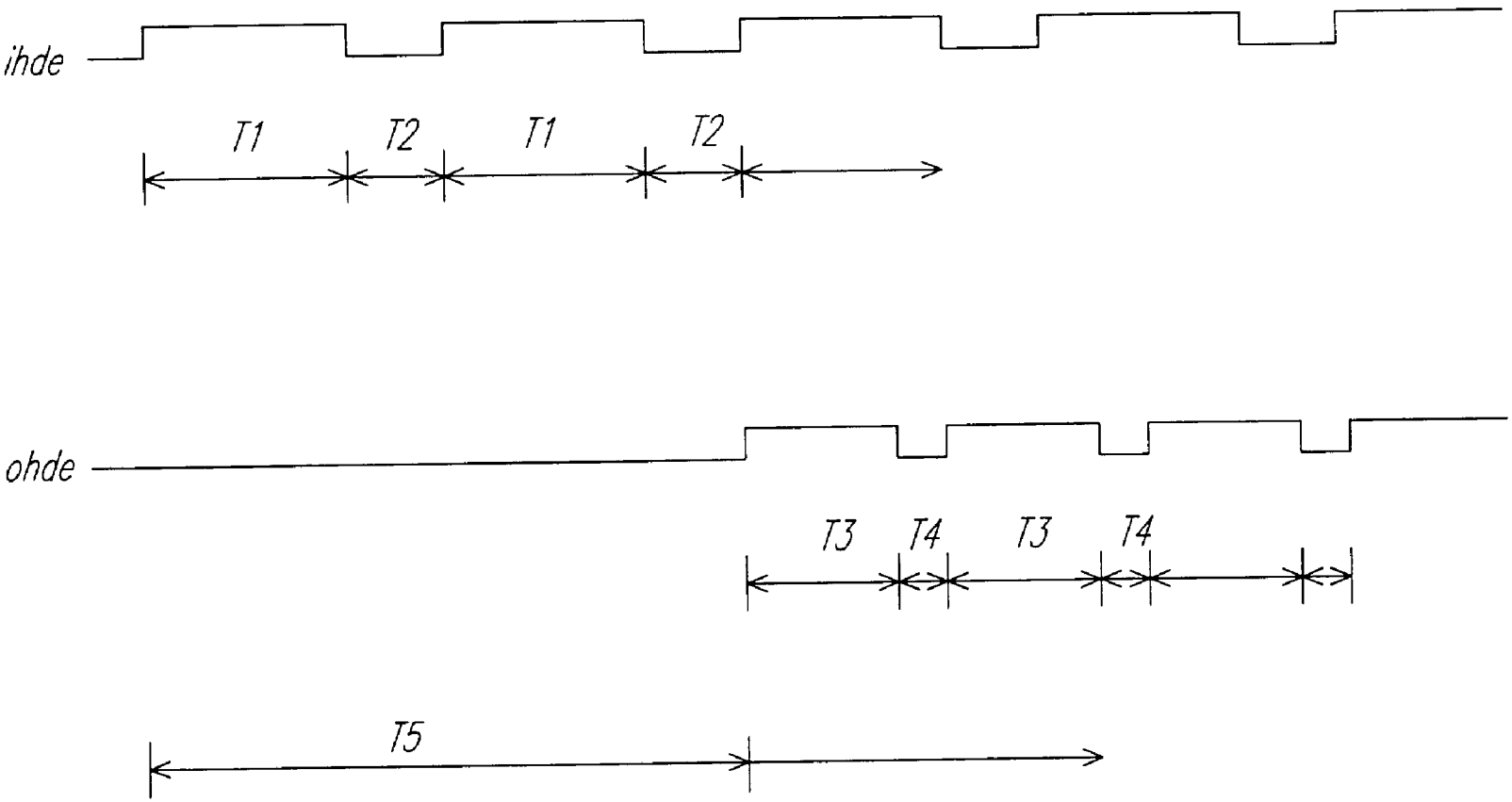
FIG. 4 is a timing diagram of the input write and output read sequences used for explanation.

FIG. 4 is a timing diagram of the input write and output read sequences used for explanation. Input timing is shown: T1=ipclk×ihde is the time period for writing valid pixels, T2=ipclk×iblank is the blank time period, and T1+T2=ipclk×ihtot is the total period of an input scan line. The display controller sequentially writes each input pixel line during each T1 period into the line buffer 106 by the sequence of the blocks 0, 1, 2, 3, . . . , n−2, n−1, in the line buffer and then back to the blocks 0, 1, 2, 3, . . . , n−2, n−1, in the line buffer and again and again as depicted in FIG. 3 until the last input valid scan line. Output timing is shown: T5 is the wait time during the write operation before the read operation starts. T3=opclk×ohde is the time period for reading valid pixels, T4=opclk×oblank is the blank time period, and T3+T4=opclk×ohtot is the total period of an output scan line. The display controller reads each pixel line during each T3 period from the line buffer 106 by the sequence of the blocks 0, 1, 2, 3, . . . , n−2, n−1, in the line buffer and then back to blocks 0, 1, 2, 3, . . . n−2, n−1 in the line buffer over and over again until the last output scan line. However, the following input scan line must be written into the next adjacent block for the write operation, but read operation may not jump to the next adjacent block after reading the output scan line from the preceding block. The following read operation may stay on the same block or not follow consecutively but jumping several blocks based upon the vertical scaling ratio.

Ideally, no buffer overrun or underrun will occur during read/write operations as long as the input line rate and the output line rate reach a balanced condition. However, underrun will occur if the output line rate is too fast, and overrun will occur if the output line rate is too slow. According to the present invention, the output line rate is automatically tuned by means of updating the number ohtot by the auto-tune control 112. Using iteration for several frames until no buffer overrun or underrun condition exists. Though the frequency of the output clock opclk can be changed to tune the output line rate, the output clock opclk of the present invention is predetermined and fixed upon display panel specification. However, for easy and precision, adjustment of the ohtot value is a better choice than opclk due to less parameter involved and a more precise tuning is achieved.

Figure 6:
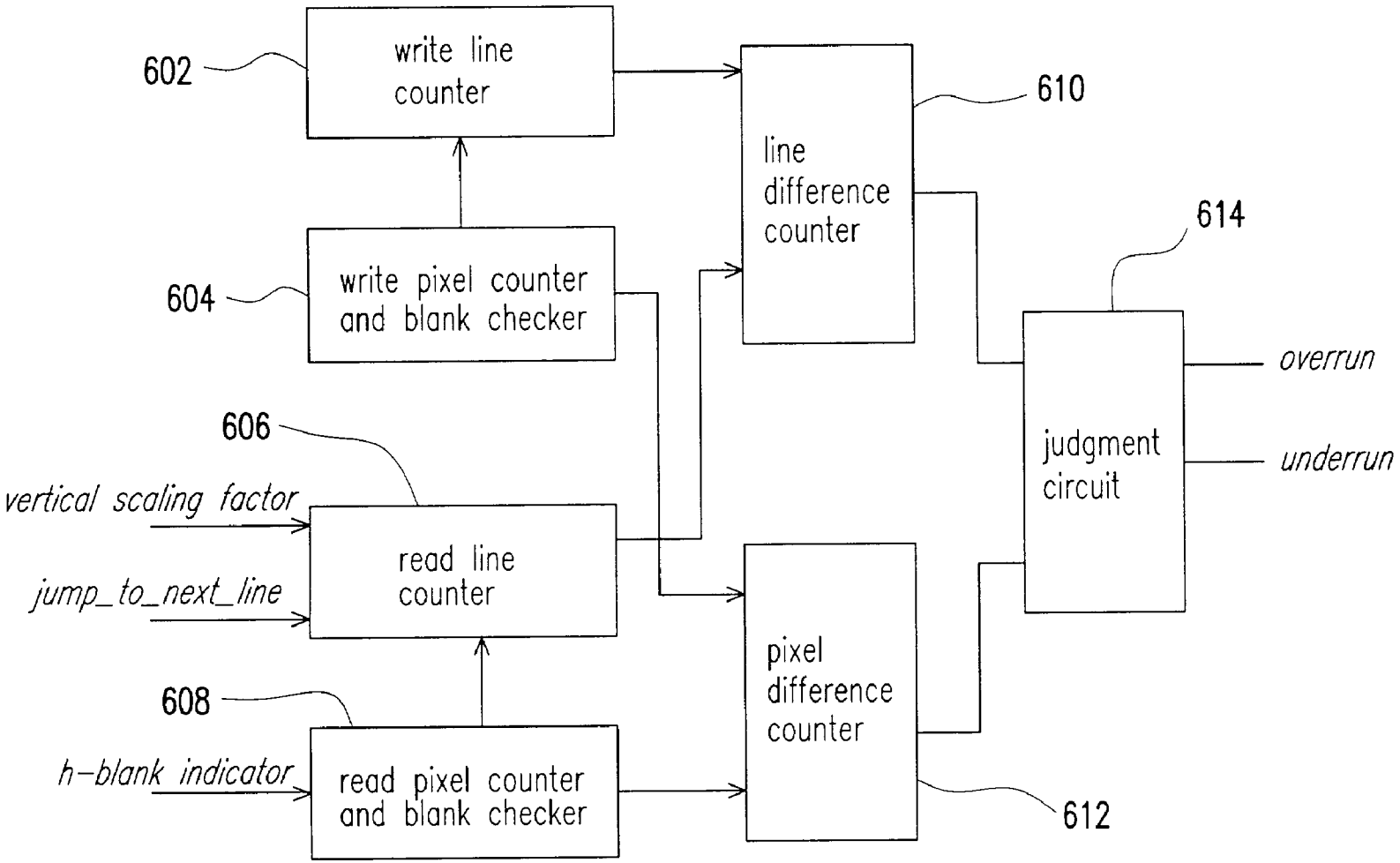
FIG. 6 is a block diagram of the line buffer status detector in FIG. 1 in accordance with the present invention.

Referring to FIG. 6, a block diagram of the line buffer status detector 116 of FIG. 1 in accordance with the present invention is schematically illustrated. In FIG. 6, the line buffer status detector 116 comprises a write line counter 602, a write pixel counter and blank checker 604, a read line counter 606, a read pixel counter and blank checker 608, a line difference counter 610, a pixel difference counter 612, and a judgment circuit 614. The write line counter 602 generates a write line count for the line difference counter 610 in response to the write pixel count and write blank data provided by the write pixel counter and blank checker 604. The read pixel counter and blank checker 608 receives h-blank indicator and generates read pixel count and read blank data for the read line counter 606. The read line counter 606 receives a vertical scaling factor and jump_to_next_line indicator, which decides whether the read operation stays in the same line or jump to the next line, wherein the next line does not necessarily mean the next consecutive line and can be the next 2 line. In addition, the read line counter 606 also generates a read line count to the line difference counter 610 in response to the read pixel count and read blank data provided by the read pixel counter and blank checker 608. The line difference counter 610 receives the write line count and the read line count from the write line counter 602 and the read line counter 606, respectively, so as to measure the line difference between the corresponding write/read operations. Alternatively, the pixel difference counter 612 receives the write pixel count and read pixel count from the write pixel counter 604 and the read pixel counter 608, respectively, so as to measure the pixel difference between the corresponding write/read operations. The judgment circuit 614 is utilized to derive the status of overrun or underrun indicators in response to the line difference and the pixel difference provided by the line difference counter 610 and the pixel difference counter 612 respectively.

Figure 7:
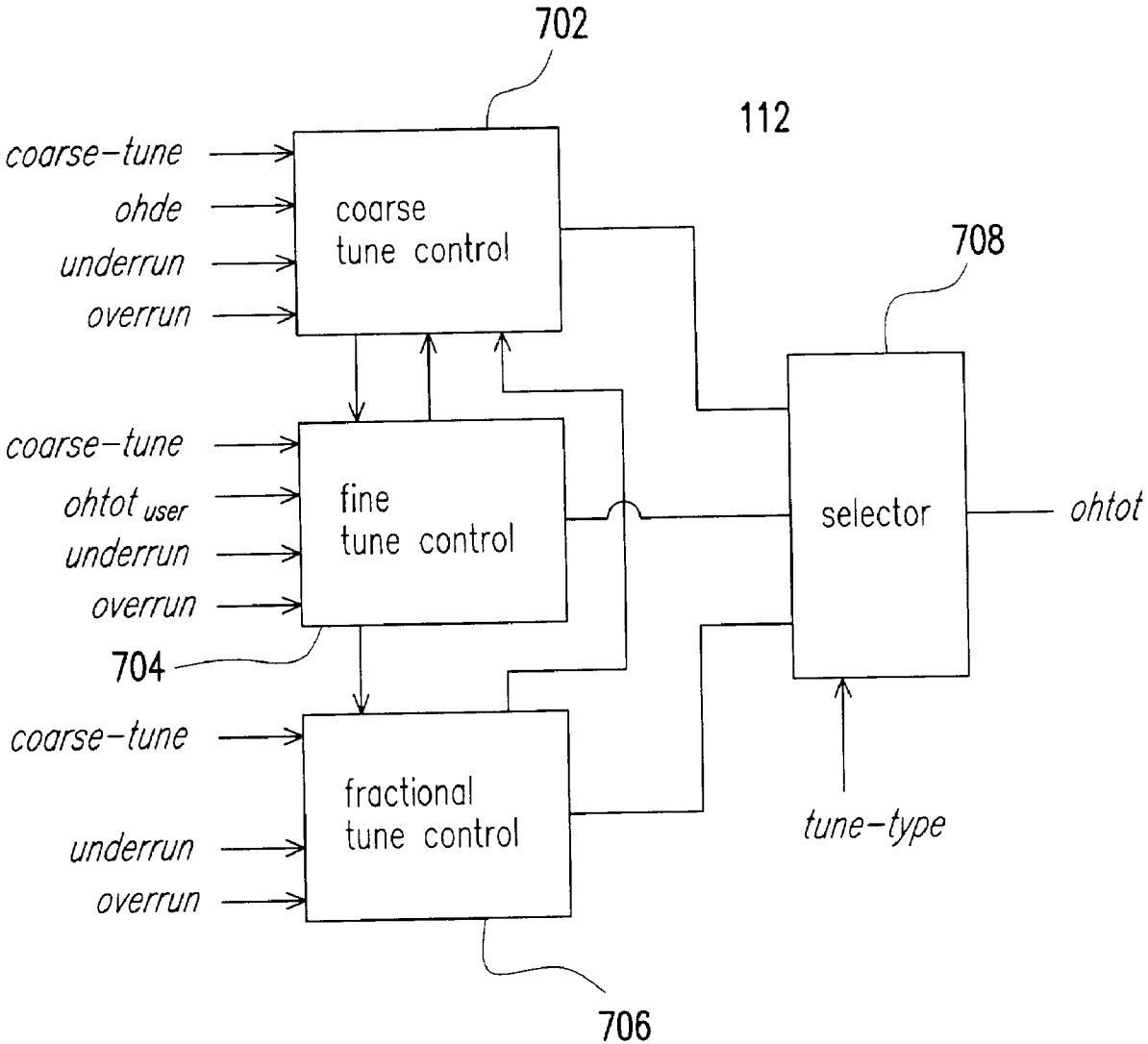
FIG. 7 is a block diagram of the auto-tune control in FIG. 1 in accordance with the present invention.

Referring to FIG. 7, a block diagram of the auto-tune control 112 in FIG. 1 in accordance with the present invention is schematically illustrated. In FIG. 7, the auto-tune control 112 comprises a coarse tune control 702, a fine tune control 704, a fractional tune control 706, and a selector 708. According to the present invention, the initial value of ohtot can be either the output horizontal display enable number ohde or a user-programmed number $ohtot_{user}$ in response to whether an coarse-tune bit is set or not. If the coarse-tune bit is found to be set, ohde is sent to the coarse tune control 702 as the initial value of ohtot; however, if the coarse-tune bit is found to be unset, $ohtot_{user}$ is sent to the fine tune control 704 as the initial value of ohtot. Note that coarse tune control 702 is not involved when $ohtot_{user}$ is chosen. According to the present invention, the coarse tune control 702, fine tune control 704 and fractional tune control 706 are employed to perform coarse tune, fine tune and fractional tune, respectively. The terms "coarse tune," "fine tune" and "fractional tune" are defined as follows:

(1) Coarse tune: ohtot is changed by an integer greater than one;
(2) Fine tune: ohtot is exactly changed by one; and
(3) Fractional tune: ohtot is changed by a fraction smaller than one.

The three-phased auto-tune method is hardware-based and therefore does not require any software or firmware for operation. According to the present invention, the line buffer status detector 116 monitors the read and write operations made to the line buffer 106, and thus generates overrun/underrun indication at the end of each frame. The overrun and underrun indicators are provided for the auto-tune control 112 so as to update ohtot according to the three-phased auto-tune method and thus tune the output line rate, accordingly. The updated ohtot is generated by one of the coarse tune control 702, the fine tune control 704, and the fractional tune control 706. The selector 708 is used to select the updated ohtot according to a tune-type signal, which designates one output of the coarse tune control 702, the fine tune control 704 and the fractional tune control 706 as the updated ohtot. The updated ohtot is thereafter processed by the output counter and up-scaler 108 which generates the corresponding output timing for the next frame. The ohtot-updated cycle continues until no underrun or overrun occurs.

Figure 8:
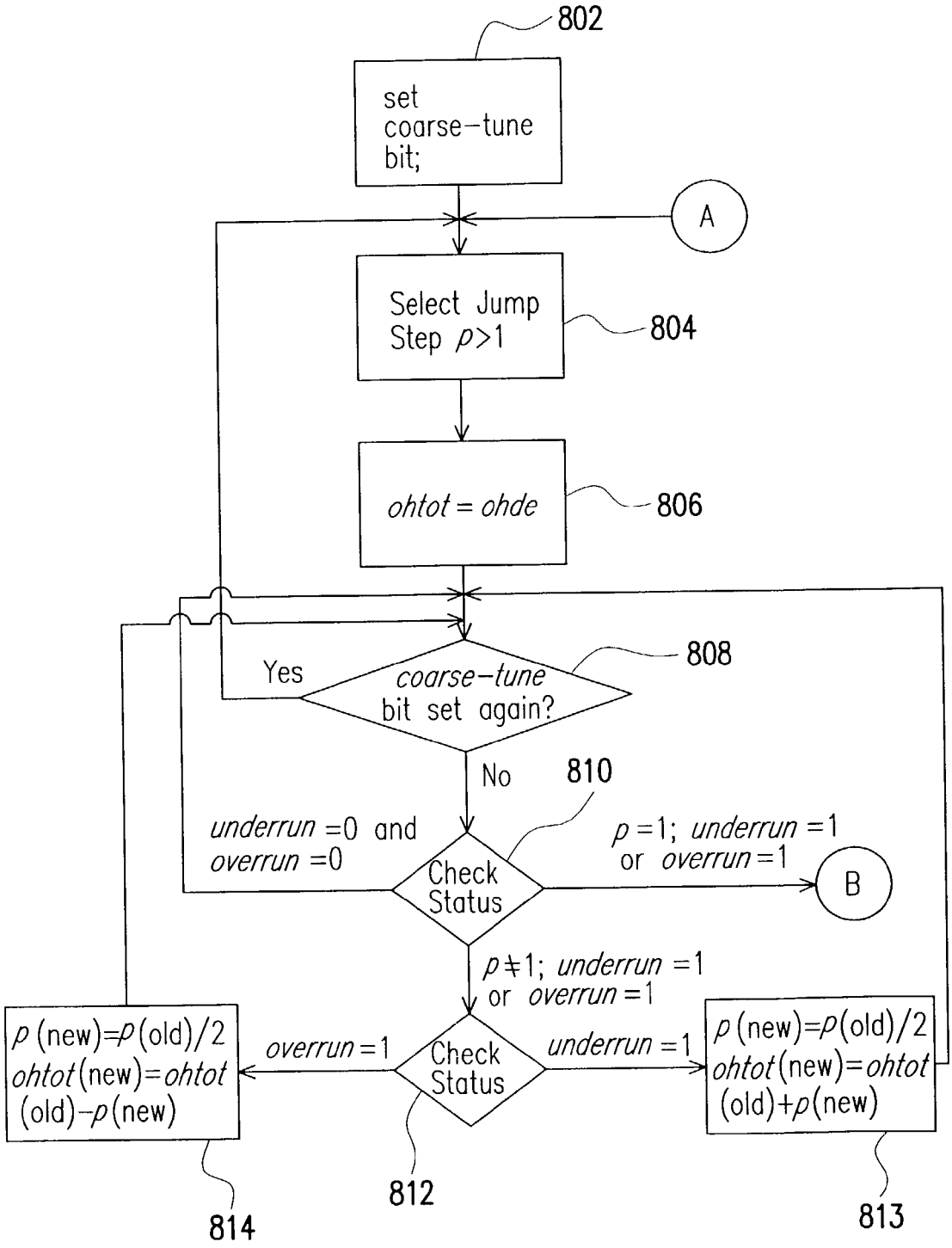
FIG. 8 is a flow chart of the coarse tune method according to the present invention.

The detailed operations of the coarse tune control 702, fine tune control 704 and fractional tune control 706 will be described in FIGS. 8, 9, and 10, respectively. FIG. 8 is a flow chart diagram of the coarse tune method according to the present invention. As shown in FIG. 8, the coarse-tune bit is set in Step 802 when the auto-tune method is required and thus enabled, and then an initial jump step p (p>1) is chosen in Step 804. The initial jump step p can be selected within the range of 2~512; preferably, p=512 or 256 in the application of XGA display mode. Next, the initial value of ohtot is set to ohde in Step 806. By proceeding to Step 808, the coarse-tune bit is checked again as to whether the display system is reset and/or input frame mode (e.g., input resolution, polarity, . . . , etc.) is changed again even though the auto-tune method has not been finalized yet; if yes, the flow goes back to Step 804, and, if no, the flow goes to Step 810 to check the statuses of the overrun and underrun indicators generated by the line buffer status detector 116. Note that the statuses of the underrun and overrun indicators are checked at the end of each image frame. If no buffer underrun or overrun occurs, that is, underrun=0 and overrun=0, the flow goes back to Step 808 by iterating Steps 808 and 810 as well. If p≠1 and buffer underrun or overrun occurs, that is, overrun=1 or underrun=1, the flow goes to Step 812 to check either overrun=1 or underrun=1; if p=1 and buffer underrun or overrun occurs, that is, overrun=1 or underrun=1, the flow goes to Step 906 to be processed upon the fine tune method. If underrun=1 is found in Step 812 which means the output line rate is too fast, the jump step p is updated by p(old)/2 and ohtot is updated by [ohtot(old)+p(old)/2] as depicted in Step 813; if overrun=1 is found in Step 812 which means the output line rate is too slow, the jump step p is updated byp(old)/2 and ohtot is updated by [ohtot(old)−p(old)/2] as depicted in Step 814. The updated jump step p and the updated ohtot obtained in Steps 813 and 814 are thereafter applied to the next frame and the flow goes back to Step 808 as shown in FIG. 8.

Figure 9:
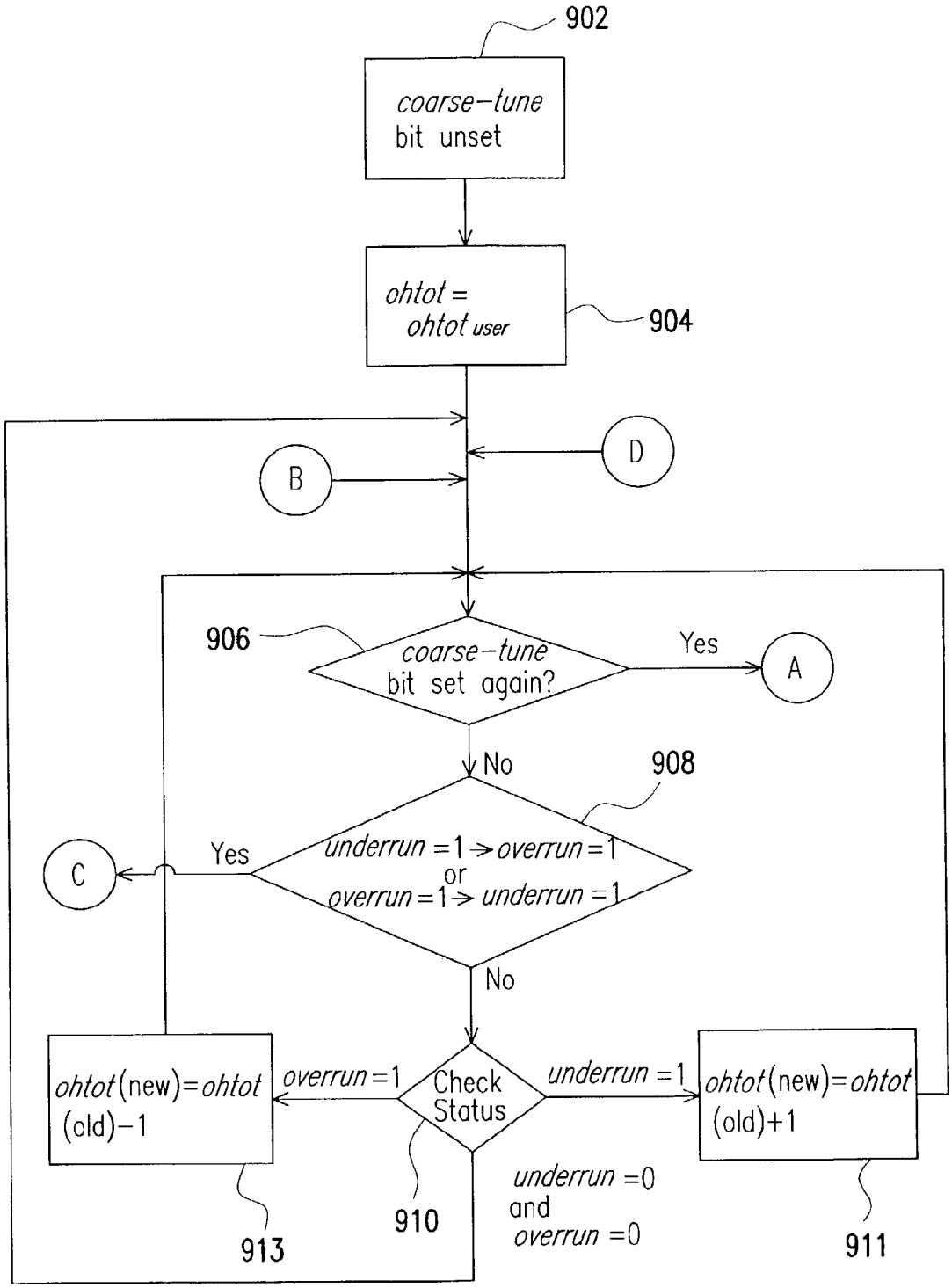
FIG. 9 is a flow chart of the fine tune method according to the present invention.

FIG. 9 is a flow chart diagram of the fine tune method according to the present invention. In FIG. 9, the fine tune method retains the option of being independent of the coarse tune method if the coarse-tune bit is not set so the fine tune method can be initialized on its own by choosing $ohtot_{user}$ to be the initial value of ohtot. As shown in FIG. 9, the hardware will pick a user-programmed $ohtot_{user}$ as the initial value of ohtot in Step 904 if the coarse-tune bit is found unset in Step 902. Next, in Step 906, the coarse-tune bit is checked again as to whether the display system is reset and/or input frame mode (e.g., input resolution, polarity, . . . , etc.) is changed; if yes, the flow goes back to Step 804. According to the present invention, when the input frame mode (e.g. input resolution, polarity, . . . , etc.) is found to be changed, it means that the previous condition has been reset and the auto-tune mechanism is reset by setting the coarse-tune bit for the new input frame mode. If the coarse-tune bit is checked in Step 906 and not set at all, the flow proceeds to Step 908 to compare the statuses of the current frame and the previous frame.

If the current status of overrun=1 and underrun=0 and the previous status of overrun=0 and underrun=1, it means that the fractional tune is required and thus the flow should proceed to Step 1004. For the same reason, if the current status of overrun=0 and underrun=1 and the previous status of overrun=1 and underrun=0, it also means that the fractional tune is required and thus the flow should proceed to Step 1004. Otherwise, the fine tune flow goes to Step 910 to check the current status of either overrun=1 or underrun=1. If underrun=1 is found in Step 910 which means the output line rate is too fast, the value of ohtot is updated by [ohtot(old)+1] as depicted in Step 911. If overrun=1 is found in Step 910 which means the output line rate is too slow, ohtot is updated by [ohtot(old)−1] as depicted in Step 913. The updated ohtot obtained in Steps 911 and 913 is thereafter applied to the next frame and the fine tune flow goes back to Step 906 as shown. Note that if overrun=0 and underrun=0 are found in Step 910 which means no overrun and underrun occurs, the flow then goes back to Step 906 for iterating Steps 906, 908, 910 as depicted in FIG. 9.

Figure 10:
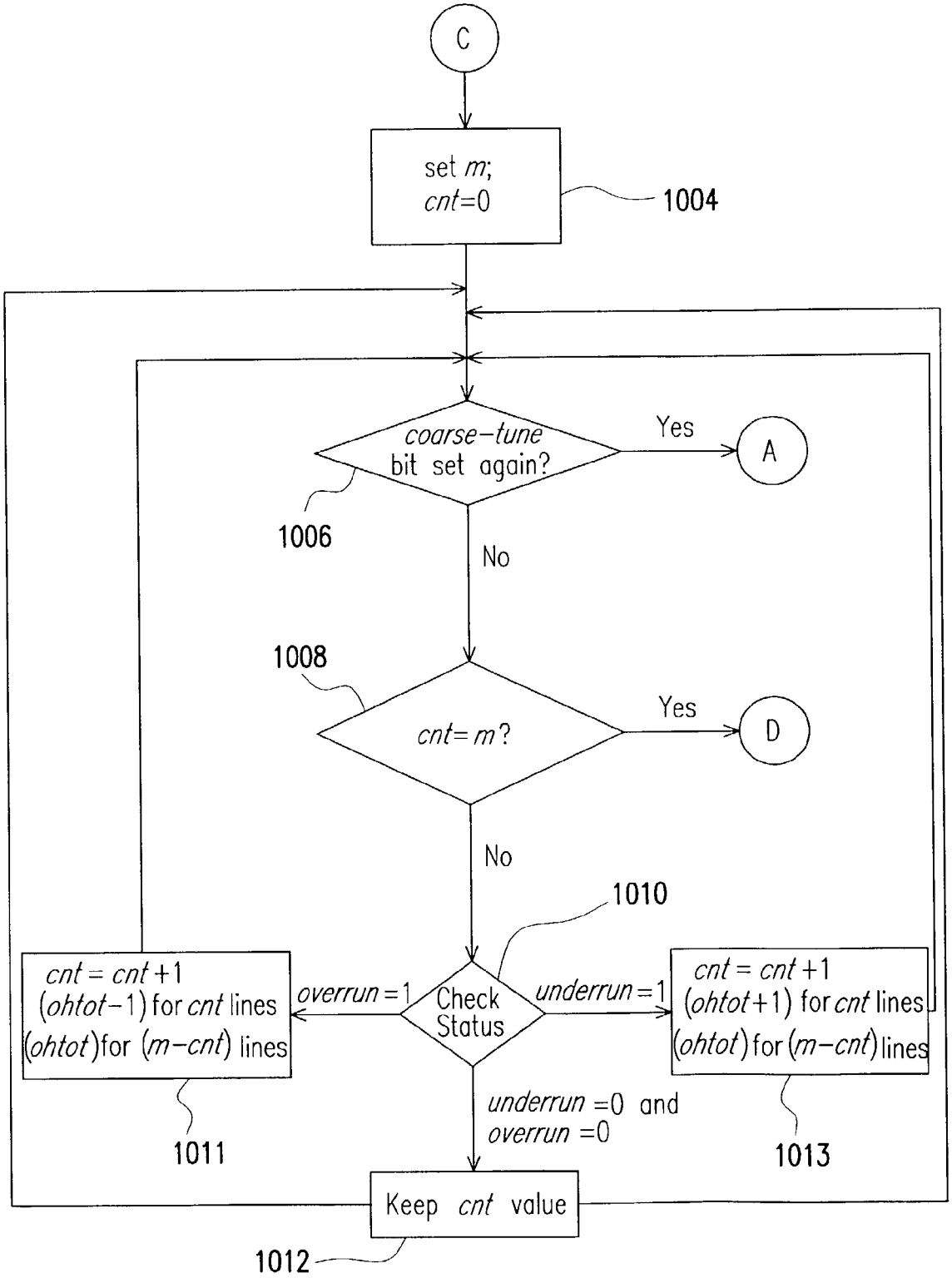
FIG. 10 is a flow chart of the fractional tune method according to the present invention.

Referring to FIG. 10, a flow chart diagram of the fractional tune method according to the present invention is schematically illustrated. In Step 1004, the fraction number m is set by the user program and a count number cnt is reset to 0. The operation then proceeds to Step 1006 to check the coarse-tune bit again as to whether the display system has been reset and/or the input frame mode (e.g., input resolution, polarity, . . . , etc.) has been changed; if yes, the flow goes back to Step 804 as depicted in FIG. 8. According to the present invention, when the input frame mode (e.g. input resolution, polarity, . . . etc) is found to be changed, it means that the previous condition has been reset and the auto-tune mechanism is required by setting the coarse-tune bit for the new input frame mode. If the coarse-tune bit is checked in Step 1006 and not set at all, the flow proceeds to Step 1008 to determine if the count number cnt is equal to the fraction number m. If cnt=m is found in Step 1008 and thus no solution for the fractional tune in the range from cnt=0 to cnt=m can be concluded, the fractional tune flow proceeds to Step 906 to issue a failure flag to inform the user to try another value of m. If cnt is not equal to m, the fractional tune flow proceeds to Step 1010 to check the statuses of buffer underrun and overrun indicators.

If underrun=1 is found in Step 1010 which means the output line rate is too fast, the count number cnt is updated by [cnt(old)+1] as depicted in Step 1013. Therefore, among m scan lines, there are cnt lines with output horizontal total number (ohtot+1) and (m−cnt) scan lines with the output horizontal total number ohtot. This arrangement can slow down the output line rate. To the contrary, if overrun=1 is found in Step 1010 which means the output line rate is too slow, the count number cnt is updated by [cnt(old)+1] as depicted in Step 1011. Accordingly, among m scan lines, there are cnt lines with output horizontal total number (ohtot−1) and (m−cnt) scan lines with output horizontal total number ohtot. After Steps 1011 and 1013 are completed, the flow goes back to Step 1006. In addition, if underrun=0 and overrun=0 are found in Step 1010, the flow proceeds to Step 1012 to keep the count number cnt and then goes back to Step 1006.

Figure 5:
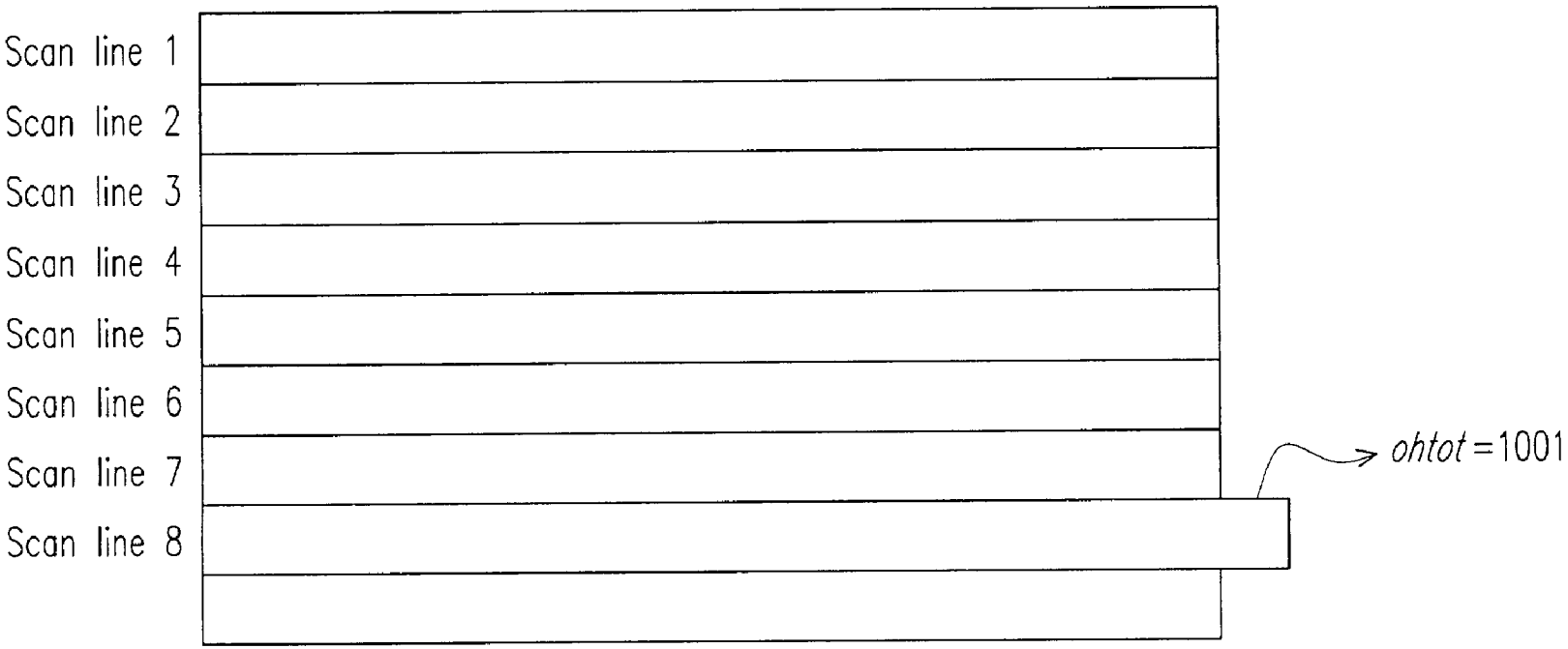
FIG. 5 is an example of implementing the output horizontal total number ohtot containing a fraction.

Furthermore, according to the auto-tune method of the present invention, the output horizontal total number ohtot can not be an integer but containing a fraction. For example, the fraction number m=8 and the count number cnt=1 are obtained eventually; therefore, ohtot=(1000+1/8) or (999+7/8). As shown in FIG. 5, by taking ohtot=(1000+1/8) as an example, it is implemented by means of every 8 scan lines provided with seven scan lines of ohtot=1000 and one scan line of ohtot=1001.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display controller, comprising:

a line buffer;

an input means for writing line data into said line buffer at an input line rate;

an output means for reading said written line data from said line buffer at an output line rate;

a status detector coupled to said input means and said output means for generating a status signal indicating whether said input line rate and said output line rate are unbalanced; and an auto-tune control means for adjusting said output line rate with bisection in response to said status signal so as to balance said input line rate and said output line rate.

2. The display controller as claimed in claim 1, wherein said auto-tune control means adjusts said output line rate by updating an output horizontal total number thereof.

3. The display controller as claimed in claim 2, wherein said auto-tune control means comprises:

a coarse tune control means for adjusting said output horizontal total number with said bisection by an integer greater than one; and a fine tune control means for adjusting said output horizontal total number by one.

4. The display controller as claimed in claim 3, wherein said auto-tune control means further comprises a fractional tune control means for adjusting said output horizontal total number by a fraction less than one.

5. The display controller as claimed in claim 2 wherein said output means further comprising means for generating output timing in response to said updated output horizontal total number.

6. The display controller as claimed in claim 1, wherein said line buffer comprises a plurality of n blocks coupled in form of a ring.

7. An auto-tune method, comprising:

(a) writing line data into a line buffer at an input line rate;

(b) reading said written line data from said line buffer at an output line rate;

(c) detecting said input line rate and said output line rate;

(d) generating a status signal indicating whether said input line rate and said output line rate are detected to be unbalanced; and (e) adjusting said output line rate with bisection responsive to said status signal so as to balance said input line rate and said output line rate.

8. The method as claimed in claim 7, wherein in step (e) said output line rate is adjusted by updating an output horizontal total number thereof.

9. The method as claimed in claim 8, wherein in step (e) further comprises:

(e1) adjusting said output horizontal total number with said bisection by an integer greater than one;

(e2) adjusting said output horizontal total number by one.

10. The method as claimed in claim 9, wherein in step (e) further comprises:

(e3) adjusting said output horizontal number by a fraction less than one.

11. A display controller, comprising:

a line buffer;

an input sampler for writing line data associated with an input image into said line buffer during a write operation;

an output counter for reading said written line data from said line buffer at an output rate during a read operation;

a status detector for generating a status signal in response to a difference between said write and read operations; and an auto-tune control for adjusting said output rate with bisection in response to said status signal so as to balance said input line rate and said output line rate.

12. The display controller as claimed in claim 11, wherein said input sampler comprises a down-scaler.

13. The display controller as claimed in claim 11, wherein said output sampler comprises an up-scaler.

14. The display controller as claimed in claim 11, wherein said difference comprises a line difference and a pixel difference.

15. The display controller as claimed in claim 14, wherein said status detector comprises:

a line difference counter coupled to said input sampler and said output counter for generating said line difference;

a pixel difference counter coupled to said input sampler and said output counter for generating said pixel difference;

a judgment circuit for generating said status signal responsive to said line difference and said pixel difference.

16. The display controller as claimed in claim 11, wherein said auto-tune control adjusts said output rate by updating an output horizontal total number thereof.

17. The display controller as claimed in claim 16, wherein said auto-tune control comprises:

a first unit for adjusting said output horizontal total number by an integer greater than one;

a second unit for adjusting said output horizontal total number by one; and a third unit for adjusting said output horizontal total number by a fraction less than one.

18. The display controller as claimed in claim 16, wherein said auto-tune control comprises:

a first unit for adjusting said output horizontal total number by one; and a second unit for adjusting said output horizontal total number by a fraction less than one.

19. An auto-tune method, comprising the following steps of:

(a) writing line data associated with an input image into a line buffer during a write operation;

(b) reading said written line data from said line buffer at an output rate during a read operation;

(c) generating a status signal responsive a difference between said write and read operation; and (d) adjusting said output rate with bisection in response to said status signal so as to balance said input line rate and said output line rate.

20. The method as claimed in claim 19, wherein said difference comprises a line difference and a pixel difference.

21. The method as claimed in claim 20, wherein in step (c) further comprises:

(c1) generating said line difference;

(c2) generating said pixel difference; and (c3) generating said status signal responsive to said line difference and said pixel difference.

22. The method as claimed in claim 19, wherein in step (d) said output rate is adjusted by updating an output horizontal total number thereof.

23. The method as claimed in claim 22, wherein in step (d) further comprises:

(d1) adjusting said output horizontal total number by an integer greater than one;

(d2) adjusting said output horizontal total number by one; and (d3) adjusting said output horizontal total number by a fraction less than one.

24. The method as claimed in claim 22, wherein in step (d) further comprises:

(d1) adjusting said output horizontal total number by one; and (d2) adjusting said output horizontal total number by a fraction less than one.

* * * * *